US006312484B1

(12) United States Patent
Chou et al.

(10) Patent No.: US 6,312,484 B1
(45) **Date of Patent: *Nov. 6, 2001**

(54) NONWOVEN ABRASIVE ARTICLES AND METHOD OF PREPARING SAME

(75) Inventors: Yeun J. Chou, Woodbury; John L. Erickson, *deceased*, late of White Bear Lake, both of MN (US), by Daneeta L. Erikson, executor; Thomas L. Jones, New Richmond, WI (US); Edward J. Woo, Woodbury, MN (US)

(73) Assignee: 3M Innovative Properties Company, St. Paul, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/218,385

(22) Filed: Dec. 22, 1998

(51) Int. Cl.[7] ..... B24D 3/02; B24D 3/28; B24D 11/00

(52) U.S. Cl. ..... 51/298; 51/295; 51/297; 51/306; 51/309

(58) Field of Search ..... 51/295, 297, 298, 51/306, 309

(56) References Cited

U.S. PATENT DOCUMENTS

| | | |
|---|---|---|
| 2,881,064 | 4/1959 | Rankin et al. . |
| 2,931,089 | 4/1960 | Evans . |
| 2,958,593 | 11/1960 | Hoover et al. . |
| 3,256,075 | 6/1966 | Kirk et al. . |
| 3,296,022 | 1/1967 | Timmer et al. . |
| 3,537,121 | 11/1970 | McAvoy . |
| 3,594,865 | 7/1971 | Erb . |
| 3,595,738 | 7/1971 | Clarke et al. . |
| 3,605,349 | 9/1971 | Anthon . |
| 3,619,874 | 11/1971 | Li et al. . |
| 3,868,749 | 3/1975 | Cate . |
| 4,170,481 | 10/1979 | Akama et al. . |
| 4,255,164 | 3/1981 | Butzke et al. . |
| 4,314,824 | 2/1982 | Leitheiser et al. . |
| 4,480,009 | 10/1984 | Berger . |
| 4,481,280 | 11/1984 | Fujikawa et al. . |
| 4,601,937 | 7/1986 | Latussek . |
| 4,623,364 | 11/1986 | Cottringer et al. . |
| 4,652,274 | 3/1987 | Boettcher et al. . |
| 4,728,571 | 3/1988 | Clemens et al. . |
| 4,735,632 | 4/1988 | Oxman et al. . |
| 4,744,802 | 5/1988 | Schwabel . |
| 4,751,138 | 6/1988 | Tumey et al. . |
| 4,770,671 | 9/1988 | Monroe et al. . |
| 4,773,920 | 9/1988 | Chasman et al. . |
| 4,881,951 | 11/1989 | Wood et al. . |
| 4,903,440 | 2/1990 | Larson et al. . |
| 4,950,696 | 8/1990 | Palazotto et al. . |
| 4,959,265 | 9/1990 | Wood et al. . |
| 4,967,465 | 11/1990 | Sernlieb et al. . |
| 4,972,037 | 11/1990 | Garbe et al. . |
| 4,973,338 | 11/1990 | Gaeta et al. . |
| 4,981,903 | 1/1991 | Garbe et al. . |
| 4,985,340 | 1/1991 | Palazzotto et al. . |
| 5,014,468 | 5/1991 | Ravipati et al. . |
| 5,015,266 | 5/1991 | Yamamoto . |
| 5,021,477 | 6/1991 | Garbe et al. . |
| 5,032,460 | 7/1991 | Kantner et al. . |
| 5,077,870 | 1/1992 | Melbye et al. . |
| 5,082,720 | 1/1992 | Hayes . |
| 5,143,779 | 9/1992 | Newkirk et al. . |
| 5,152,917 | 10/1992 | Pieper et al. . |
| 5,178,646 | 1/1993 | Barber, Jr. et al. . |
| 5,198,057 | 3/1993 | Newkirk et al. . |
| 5,213,589 | 5/1993 | Ronning et al. . |
| 5,236,472 | 8/1993 | Kirk et al. . |
| 5,256,170 | 10/1993 | Harmer et al. . |
| 5,271,997 | 12/1993 | Baigas, Jr. . |
| 5,304,223 | 4/1994 | Pieper et al. . |
| 5,368,925 | 11/1994 | Hosokawa et al. . |
| 5,378,252 | 1/1995 | Follensbee . |
| 5,435,816 | 7/1995 | Spurgeon et al. . |
| 5,437,754 | 8/1995 | Calhoun . |
| 5,453,312 | 9/1995 | Haas et al. . |
| 5,454,844 | 10/1995 | Hibbard et al. . |
| 5,468,477 | 11/1995 | Kumar et al. . |
| 5,489,235 | 2/1996 | Gagliardi et al. . |
| 5,578,097 | 11/1996 | Gaeta et al. . |
| 5,580,647 | 12/1996 | Larson et al. . |
| 5,624,471 | 4/1997 | Gaeta et al. . |
| 5,663,211 | 9/1997 | Kominami et al. . |
| 5,681,612 | 10/1997 | Benedict et al. . |
| 5,700,302 * | 12/1997 | Stoetzel et al. ..... 51/295 |
| 5,773,120 | 6/1998 | Deka et al. . |
| 5,837,745 | 11/1998 | Safta et al. . |
| 5,942,015 * | 8/1999 | Culler et al. ..... 51/295 |

FOREIGN PATENT DOCUMENTS

| | | |
|---|---|---|
| 0 321 704 | 6/1989 | (EP) . |
| 0 370 658 | 5/1990 | (EP) . |
| 0 500 369 | 8/1992 | (EP) . |
| 0 538 047 | 4/1993 | (EP) . |
| 0 560 059 | 9/1993 | (EP) . |
| 0 625 430 | 11/1994 | (EP) . |
| 2 314 791 | 1/1998 | (GB) . |

(List continued on next page.)

*Primary Examiner*—Michael Marcheschi
(74) *Attorney, Agent, or Firm*—Scott R. Pribnow

(57) ABSTRACT

An abrasive article is provided having a rebulkable nonwoven web and a continuous sheet-like abrasive coating bonded to the first major surface of the nonwoven web. The abrasive coating comprising a plurality of abrasive particles dispersed in a binder.

33 Claims, 2 Drawing Sheets

FOREIGN PATENT DOCUMENTS

| | | |
|---|---|---|
| WO 94/04738 | 3/1994 | (WO) . |
| WO 95/07797 | 3/1995 | (WO) . |
| WO 95/22436 | 8/1995 | (WO) . |
| WO 96/21539 | 7/1996 | (WO) . |
| WO 96/33841 | 10/1996 | (WO) . |
| WO 96/37644 | 11/1996 | (WO) . |
| WO 97/14720 | 4/1997 | (WO) . |
| WO 98/03307 | 1/1998 | (WO) . |
| WO 98/12021 | 3/1998 | (WO) . |
| WO 99/65352 | 12/1999 | (WO) . |

* cited by examiner

NONWOVEN ABRASIVE ARTICLES AND METHOD OF PREPARING SAME

BACKGROUND

This invention relates to nonwoven abrasive articles and methods of making same. More particularly, this invention relates to nonwoven abrasive articles having a rebulkable nonwoven web with a continuous sheet-like abrasive coating and methods of making same.

The use of nonwoven abrasive products for abrading, polishing, cleaning, conditioning, and/or decorating the surfaces of metal, wood, plastics, ceramics, and the like is known. Nonwoven abrasive products may be formed of randomly disposed staple fibers which are bonded together at points of contact with a binder and may optionally contain abrasive particles. Typically, the staple fibers have been crimped and are laid into lofty open webs by equipment such as a "Rando-Webber" machine (available from Rando Machine Corporation, Macedon, N.Y.). One commercial embodiment of such an abrasive article is available under the trade designation "SCOTCH-BRITE" (available from Minnesota Mining and Manufacturing Company of St. Paul, Minn.).

Nonwoven abrasive articles of this type can be prepared by the method disclosed in U.S. Pat. No. 2,958,593 (Hoover et al.). Hoover et al. reports such nonwoven webs as comprising many interlaced randomly disposed flexible durable tough organic fibers. The fibers of the nonwoven web are firmly bonded together at points where they intersect and contact one another by globules of an organic binder, thereby forming a three-dimensionally integrated structure. Distributed throughout the nonwoven web are abrasive particles which are bonded to the fibers by the binder. These abrasive articles may be described as being "open" in that the interior portion of the nonwoven web is open to the surface being abraded. An open construction allows for swarf from the workpiece to be taken up by the nonwoven web.

Rebulkable nonwoven scouring articles having an abrasive-free interior are reported in PCT published application 94/04738 (Heyer et al.). The abrasive particles are concentrated in approximately the outer one-third of the nonwoven web by applying the abrasive particles to the rebulkable nonwoven web while the web is in a densified state. The densified nonwoven web is then rebulked to provide an open nonwoven abrasive article.

Although nonwoven abrasive articles have found numerous uses, producers of nonwoven abrasive articles desire ways to provide abrasive articles suitable for new applications. An area of particular need is automotive body repair. An abrasive article is needed to quickly level and blend coated (i.e., painted) repair areas to match the surrounding original coatings without leaving unacceptable scratches.

SUMMARY

The present invention provides nonwoven abrasive articles and methods for the production of nonwoven abrasive articles. Abrasive articles of the present invention may be useful in many finishing and leveling applications and may be particularly useful to level and/or blend repainted surfaces of automobiles.

Specifically, the present invention provides an abrasive article comprising a rebulkable nonwoven web having bonded to the outermost portion of at least one major surface a continuous sheet-like abrasive coating. The abrasive coating comprises a plurality of abrasive particles dispersed in a binder. As used herein "sheet-like" is used to describe the structure of the abrasive coating which exists in the form of a sheet or film. As used herein the term "continuous" means that the abrasive coating is provided as a mass substantially free of large voids, holes or gaps over its working surface. The continuous sheet-like abrasive coating separates or closes-off the working surface of the abrasive article from the interior portion of the nonwoven web. As used herein "working surface" refers to the portion of the abrasive article which contacts the workpiece during abrading. It is to be understood that although the abrasive coating is continuous, this does not preclude having voids holes or gaps in the abrasive coating outside of the working surface of the abrasive article.

The abrasive coating has a working surface which may have any desired topography. For example, the topography may be smooth, textured, or structured. In one embodiment, the working surface has a textured topography. As used herein "textured" refers to a surface comprising a plurality of non-straight, non-distinct, inexact or imperfect shaped protuberances. A textured topography may be formed, for example, by gravure coating an abrasive slurry onto a nonwoven web.

In a preferred embodiment, the working surface has a structured topography. As used herein "structured" refers to a surface which comprises a plurality of precisely-shaped abrasive composites arranged in a predetermined pattern or array. Each abrasive composite has a predetermined shape and is made of abrasive particles dispersed in a binder. The predetermined pattern of abrasive composites may be either non-random or random.

The abrasive article includes a rebulkable nonwoven web. As used herein the term "rebulkable" is used to characterize nonwoven webs which may be converted (at least once) from a densified or compressed state (i.e., a higher density/lower loft state) to a rebulked or uncompressed state (i.e., a lower density/higher loft state). Preferred rebulkable nonwoven webs contain two types of crimped, staple, thermoplastic fibers which are arranged in the form of an open, lofty nonwoven web. Such rebulkable nonwoven webs are reported in WO 94/04738 (Heyer et al.).

In another aspect, the present invention provides a method of making an abrasive article comprising the steps of:

(a) coating a major surface of a densified rebulkable nonwoven web with an abrasive slurry;

(b) solidifying the abrasive slurry to form a continuous sheet-like abrasive coating; and (c) heating the densified rebulkable nonwoven web at a sufficient temperature and for a sufficient time to rebulk the nonwoven web.

At least one major surface of the densified rebulkable nonwoven web is coated with an abrasive slurry. The abrasive slurry comprises a plurality of abrasive particles dispersed in a binder precursor. As used herein "binder precursor" refers to a flowable or unsolidified material which may be solidified to form a binder. Preferred binder precursors are free-radically polymerizable materials such as acrylates and methacrylates. Abrasive particles include those commonly used in the abrasive art such as aluminum oxide and silicon carbide.

The abrasive slurry may be applied to the densified rebulkable nonwoven web using any suitable coating technique (e.g., gravure coating, roll coating, extrusion die coating). Among other considerations, the coating technique may be chosen to impart a desired topography to the working surface of the abrasive coating.

After coating the abrasive slurry, the binder precursor is then solidified. Depending upon the type of binder precursor, solidification may be achieved by curing (i.e., polymerizing and/or crosslinking), by drying (i.e., evaporating a liquid from a dissolved or dispersed solid), by cooling (i.e., for hot melt type binders) or by a combination of these processes. In a preferred embodiment, the abrasive slurry is solidified while it is held in a plurality of precisely-shaped cavities of a production tool. In this way, an abrasive coating having a structured topography is formed.

After solidifying the abrasive slurry, the nonwoven web is then rebulked. Rebulking typically comprises heating the densified rebulkable web to a sufficient temperature for a sufficient time such that the web substantially regains its original bulk or loft.

DETAILED DESCRIPTION

This invention pertains to nonwoven abrasive articles and to methods of making nonwoven abrasive articles. Abrasive articles of the present invention comprise a rebulkable nonwoven web having bonded to the outermost portion of at least one major surface a continuous sheet-like abrasive coating. The abrasive coating comprises a plurality of abrasive particles dispersed in a binder. In an abrasive article of the present invention the abrasive slurry is applied to a major surface of the nonwoven web while the web is in its densified form. In its densified form the nonwoven web has a larger number of fibers per volume thereby providing a more continuous, uninterrupted, major surface for application of the abrasive slurry. Application of the abrasive slurry to a densified web allows for the formation of continuous sheet-like abrasive coating on the surface of the nonwoven web.

Abrasive articles of the present invention having a continuous sheet-like abrasive coating may be suitable for surface leveling type abrasive operations. That is, these abrasive articles may be useful to make minor dimensional changes to an initially uneven or rough surface or to remove nibs or orange peel texture from a surface (e.g., a painted surface). By contrast, nonwoven abrasive articles having an open web type of construction are typically used for cleaning (e.g., removing food from a pan, stripping paint) and surface conditioning (i.e., imparting a surface texture or scratch pattern) type abrasive applications.

Figure 1:
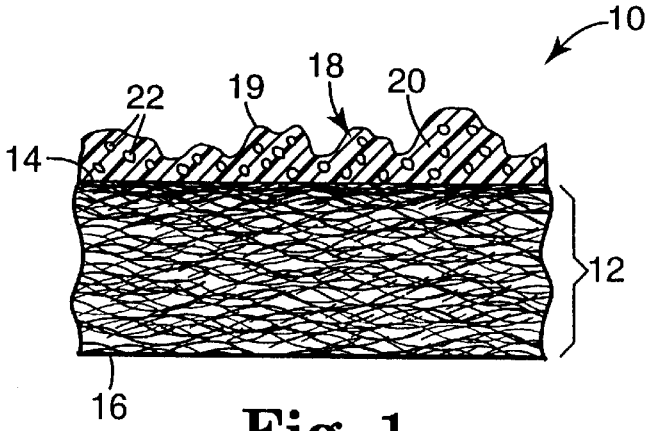
FIG. 1 is a cross-sectional view of an embodiment of an abrasive article of the present invention.

Referring now to FIG. 1, a cross sectional view of a first embodiment of an abrasive article of the present invention is shown. Abrasive article 10 comprises rebulkable nonwoven web 12 having first major surface 14 and second major surface 16. In this embodiment, first major surface 14 and second major surface 16 are planar and first major surface 14 is parallel to second major surface 16. Rebulkable nonwoven web 12 comprises a multiplicity of first fibers and a multiplicity of second bicomponent fibers which are melt-bonded together at points of mutual contact.

In some embodiments, rebulkable nonwoven web 12 retains a higher density (i.e., a higher number of fibers per unit volume) proximate first major surface 14 than throughout the bulk of nonwoven web 12. That is, abrasive coating 18, which is applied to nonwoven web 12 while in a densified form, results in the formation of fiber to fiber bonds which diminish or prevent total rebuking near major surface 14.

Abrasive coating 18 comprises binder 20 and a plurality of abrasive particles 22. Abrasive coating 18 is in the form of a sheet or film adhered to the first major surface 14 of rebulkable nonwoven web 12. Abrasive coating 18 has working surface 19 which can have any desired surface topography. In FIG. 1, the working surface 19 of abrasive coating 18 has a textured topography comprising a plurality of irregularly shaped protuberances. The second major surface 16 of abrasive article 10 may be utilized for attachment to a back-up pad or sanding block.

Figure 2:
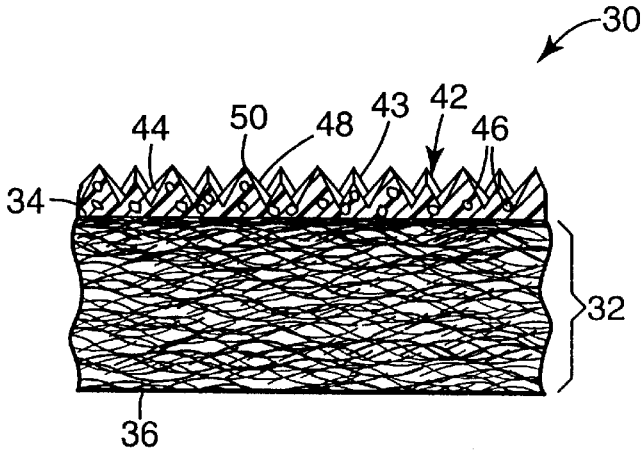
FIG. 2 is a perspective view illustrating a second embodiment of an abrasive article of the present invention.
Figure 2A:
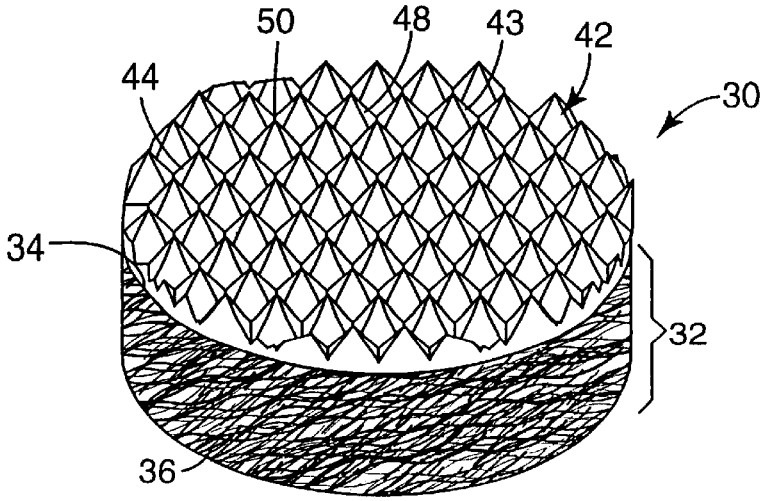
FIG. 2*a* is a cross-sectional view of a second embodiment of an abrasive article of the present invention.

Referring now to FIG. 2, a second embodiment of a cross-sectional view of a second embodiment of an abrasive article of the present invention is shown. Abrasive article 30 comprises rebulkable nonwoven web 32 having first major surface 34 and second major surface 36. Rebulkable nonwoven web 32 comprises a multiplicity of first fibers and a multiplicity of second bicomponent fibers which are melt-bonded together at points of mutual contact. First major surface 34 has bonded thereto abrasive coating 42. Abrasive coating 42 comprises binder 44 and a plurality of abrasive particles 46. Abrasive coating 42 has working surface 43 which may have any desired surface topography. In FIG. 2, working surface 43 has a structured topography comprising a plurality precisely-shaped pyramidal abrasive composites 48. Distal end 50 of abrasive composite 48 contacts the workpiece during abrading operations. A second row of abrasive composites is shown in which the second row is offset from the first row. Referring now to FIG. 2*a*, a perspective view of the embodiment of FIG. 2 is shown. Abrasive article 30 is in the form of a disc. Rebulkable Nonwoven Web:

Nonwoven webs useful in the present invention are rebulkable. Rebulkable nonwoven web may be converted (at least once) from a densified or compressed state (i.e., a high density, low loft state) to a rebulked or uncompressed state (i.e., a low density, high loft state). The process of converting the rebulkable web from the densified to the rebulked state is referred to as "rebulking." Typically, the process of rebulking the web is accomplished by heating the web. Heating the web softens at least some of the bonds formed between fibers of the web. This allows at least some of the fibers to expand to their original length thereby restoring at least a portion of the original bulk to the nonwoven web. In the densified form, nonwoven webs useful in the present invention have at least one major surface which is preferably planar or flat. The major surface provides the surface upon which an abrasive slurry is applied and solidified to form an abrasive coating.

A preferred rebulkable nonwoven web composition is reported in WO 94/04738 (Heyer et al.), the disclosure of which is incorporated herein by reference. Such rebulkable nonwoven webs comprise a multiplicity of a first fiber and a multiplicity of a second fiber which are entangled with one another and melt-bonded together. The first fibers are crimped, staple, thermoplastic organic fibers. The fibers may be stuffer-box crimped, gear crimped or helically crimped. A mixture of fibers having more than one crimp type is also within the scope of the invention. Suitable first fibers are made of polyester, polyamide, rayon or polyolefin. Suitable polyamides include, for example, polycaprolactam and poly (hexamethylene adipamide) (e.g., nylon 6 and nylon 6,6). Suitable polyolefins include, for example, polypropylene and polyethylene. Preferably, the first fibers are made of polyester, most preferably polyethylene terephthalate.

The second fibers making up the rebulkable nonwoven web are typically bicomponent fibers comprising a first higher heat stable component and a second lower heat stable component. During formation of the rebulkable nonwoven web, the second component of the bicomponent fibers melts and adheres these fibers to the other fibers in the nonwoven web. It is important that the second component of the bicomponent fibers melts at a temperature lower than the melting or degradation temperature of the first component of the bicomponent fibers and at a temperature lower than the heat set temperature of the crimping process of the first fibers. Preferably, the melting temperature of the second component is at least about 130° C. in order to avoid excessive softening from exposure to temperatures of about 150° C., which are typically present during processing. In addition, the melting temperature of the second component is preferably at least about 30° C. below the melting temperature of the first component of the bicomponent fibers.

The first component of the bicomponent fibers is typically selected from polyesters (e.g., polyethylene terephthalate), poly(phenylene sulfides), polyamides (e.g., nylon), polyimide, polyetherimide or polyolefins (e.g., polypropylene).

The second component of the bicomponent fibers typically comprises a blend of a crystalline or partially crystalline polymer and an amorphous polymer. As used herein the term "amorphous polymer" refers to a melt extrudable polymer that does not exhibit a definite first order transition temperature, (i.e., a melting temperature). The ratio of crystalline to amorphous polymer has an effect both on the degree of shrinkage of the nonwoven webs and the degree of bonding between the first and second components of the bicomponent fibers. The weight ratio of amorphous to partially crystalline polymer in the second component of the bicomponent fibers typically ranges from about 15:85 to about 90:10.

Suitable crystalline and amorphous polymers making up the second component of the bicomponent fibers must be compatible with one another (i.e., exist in a single phase) or must be capable of being rendered compatible. In addition, the second component must be capable of adhering to the first component. The blend of polymers making up the second component of the bicomponent fibers preferably comprise crystalline and amorphous polymers of the same general polymeric type. Use of polymers of the same type for both the first and second components may produce bicomponent fibers that are more resistant to separation during fiber spinning, stretching, crimping, and during formation of nonwoven webs. Polymers suitable for use as the second component include polyesters, polyolefins, and polyamides. Polyesters are typically preferred, because they provide better adhesion than do other classes of polymeric materials.

Preferred second fibers useful in the present invention have a concentric core and a sheath construction and are stuffer box crimped with about 6 to about 12 crimps per 25 mm. Alternatively, the second fibers may be of a side-by-side construction or an eccentric core and sheath construction. Preferably, the bicomponent fibers have a cut staple length of about 25 to about 100 mm and have a tenacity of about 2–3 grams/denier. Preferred bicomponent fibers are reported in U.S. Pat. No. 5,082,720 (Hayes), the disclosure of which is hereby incorporated by reference.

U.S. Pat. No. 3,595,738 (Henson et al.), the disclosure of which is incorporated herein by reference, discloses methods for the manufacture of reversing helically crimped bicomponent polyester fibers suitable for use in this invention. Fibers having a reversing helical crimp are preferred over fibers that are crimped in a coiled configuration, however, both types of fibers are suitable for this invention. U.S. Pat. Nos. 3,868,749 (Cate), 3,619,874 (Hsin. Lang. Li., et al.), and 2,931,089 (Evans), the disclosures of which are incorporated herein by reference, disclose various methods of edge crimping synthetic organic fibers to produce helically crimped fibers.

Helically crimped fibers typically and preferably have from about 1 to about 15 full cycle crimps per 25 mm fiber length, while stuffer box crimped fibers have about 3 to about 15 full cycle crimps per 25 mm fiber length. When helically crimped fibers are used along with stuffer box crimped fibers, the helically crimped fibers preferably have fewer crimps per specified length than the stuffer box fibers.

Crimp index, which provides a measure of fiber elasticity, typically ranges from about 35 to about 70 percent for helically crimped and stuffer box crimped fibers. Crimp index can be determined by measuring the fiber length when fully extended ("extended length"), measuring the fiber length when the fiber is relaxed ("relaxed length"), subtracting the relaxed length from the extended length, dividing the resulting value by the extended length, and multiplying that value by 100. The values of the appropriate load used to extend the fiber depends on the fiber denier. For fibers having 50 to 100 denier, a load of about 0.1–0.2 gram may be used. For fibers having a higher denier, a load of about 5–10 grams is used. Preferably, the crimp index of a fiber should not significantly change due to exposure to temperatures of about 135° C. to 175° C. for 5 to 15 minutes.

The length of the first and second fibers is dependent upon the limitations of the processing equipment upon which the nonwoven open web is formed. Fiber lengths suitable for helically crimped fibers typically range from about 60 mm to 150 mm. Fiber lengths suitable for stuffer box fibers range from about 25 to 70 mm.

The fiber denier may be chosen to optimize the desired properties of the nonwoven web such as porosity and strength. Higher denier fibers will typically produce a more porous web with fewer entanglements and fewer fiber-to-fiber bonding points. Hence, the strength of the web may be low and it may be difficult to maintain the web in the densified state prior to coating. Lower denier fibers generally will produce a strong, dense web. Suitable fiber denier ranges from about 1 to 500, more preferably from about 1 to 200 and most preferably from about 1 to 70. Preferably, the first and second fibers have a break strength of at least 1 gram per denier to provide the necessary degree of toughness for prolonged use of the abrasive article.

Crimped staple fibers may be processed and entangled into nonwoven webs by web-forming machines such as that sold under the trade designation "RANDO-WEBBER" (commercially available from the Rando Machine Corporation, Macedon, N.Y.). Methods useful for making nonwoven webs suitable for use in the invention from crimped, staple, synthetic fibers are reported in U.S. Pat. Nos. 2,958,593 (Hoover, et al.) and 3,537,121 (McAvoy), the disclosures of which are incorporated herein by reference. Alternatively, crimped staple fibers can be processed and entangled into nonwoven webs by carding or garnetting, followed by crosslapping to form a web of appropriate thickness. Such a crosslapped structure is generally needle-tacked to reorient a portion of the component fibers to alignment in the "z" direction (i.e., the thickness direction), thereby further entangling and integrating the web.

Rebulkable nonwoven webs useful in the present invention typically have a rebulked thickness of at least about 0.5 cm, more preferably ranging from about 2 cm to about 4 cm.

Abrasive Slurry:

The abrasive coating of an abrasive article of the present invention is formed by solidifying an abrasive slurry. An abrasive slurry comprises abrasive particles, a binder precursor and may optionally include other additives such as reactive siloxane polymers, initiators, curing agents, fillers, grinding aids, coupling agents and plasticizers.

The components of an abrasive slurry may be mixed together using any suitable mixing technique such as low shear or high shear mixing. High shear mixing is typically preferred. Ultrasonic energy may be utilized in combination with the mixing step to lower the viscosity of the abrasive slurry. Typically, the abrasive particles are gradually added to the binder precursor. It is preferred that the abrasive slurry be a homogeneous mixture of binder precursor, abrasive particles and optional additives. If necessary, water or solvent may be added to reduce the viscosity. In some instances it is preferred to heat the abrasive slurry to reduce the viscosity.

Abrasive Particles:

Useful abrasive particles have an average particle size ranging from about 0.01 to 1500 micrometers, preferably ranging from about 0.1 to 50 micrometers. As used herein, abrasive particles also includes abrasive agglomerates. The abrasive particles in the agglomerate may be chemical bonded together by an agglomerate binder or may be bonded together by inter-particle forces.

Examples of suitable abrasive particles include fused aluminum oxide, heat treated aluminum oxide, white fused aluminum oxide, black silicon carbide, green silicon carbide, titanium dibromide, boron carbide, silicon nitride, tungsten carbide, titanium carbide, monocrystalline or polycrystalline diamond, monocrystalline or polycrystalline cubic boron nitride, hexagonal boron nitride, garnet, iron oxide, zirconia, tin oxide, cerium oxide, chromia, fused alumina zirconia, alumina-based sol gel derived abrasive particles, and the like. The alumina -based sol gel derived abrasive particle may optionally contain a metal oxide modifier. Alumina-based sol gel derived abrasive particles may be found in U.S. Pat. Nos. 4,314,827 (Leitheiser et al.), 4,623,364 (Cottringer et al.), 4,744,802 (Schwabel), 4,770,671 (Monroe et al.), and 4,881,951 (Wood et al.). The abrasive article may also contain a mixture of two or more types and/or grades of abrasive particles.

Binder/Binder Precursor:

The binder of an abrasive article of the present invention is formed from a binder precursor. The binder precursor has a phase that is capable of flowing sufficiently to be coatable and can be solidified. Solidification of the binder precursor may be achieved by curing (i.e., polymerizing and/or crosslinking), by drying (i.e., evaporating a liquid from a dissolved or dispersed solid), by cooling (i.e., for hot melt type binders), or by a combination of these processes. The binder precursor may be organic solvent-borne, water-borne, or 100% solids (i.e., a substantially solvent-free). Both thermoplastic and thermosetting materials, as well as combinations thereof, may be suitable binder precursors.

Preferred binder precursors are curable materials which polymerize and/or crosslink upon exposure to heat, e-beam, ultraviolet light, visible light or upon the addition of a chemical catalyst, moisture or a combination thereof. During manufacturing, the binder precursor is exposed to the appropriate conditions to initiate the curing of the binder precursor. After curing, the binder precursor is converted into a non-flowable solid binder.

Examples of binder precursors include epoxy resins, amino resins (e.g., aminoplast resins) such as alkylated urea-formaldehyde resins, melamine-formaldehyde resins, alkylated benzoguanamine-formaldehyde resin, acrylate resins (including acrylates and methacrylates), acrylated epoxies, acrylated urethanes, acrylated polyesters, acrylated polyethers, vinyl ethers, acrylated oils, and acrylated silicones, alkyd resins such as urethane alkyd resins, polyester resins, reactive urethane resins, phenolic resins such as resole and novolac resins, phenolic/latex resins, epoxy resins such as bisphenol epoxy resins, isocyanates, isocyanurates, polysiloxane resins (including alkylalkoxysilane resins), reactive vinyl resins, and the like. The resins may be in the form of monomers, oligomers, polymers, or combinations thereof.

The preferred binder precursors cure via a free radical mechanism. These binder precursors are capable of polymerizing rapidly upon exposure to thermal and/or radiation energy. A preferred subset of free radical curable binder precursors include ethylenically unsaturated binder precursors. Examples of ethylenically unsaturated binder precursors include aminoplast monomers or oligomers having pendant alpha, beta unsaturated carbonyl groups, ethylenically unsaturated monomers or oligomers, acrylated isocyanurate monomers, acrylated urethane oligomers, acrylated epoxy monomers or oligomers, ethylenically unsaturated monomers or diluents, acrylate dispersions, and mixtures thereof. The term acrylate includes both acrylates and methacrylates.

The aminoplast binder precursors have at least one pendant alpha, beta-unsaturated carbonyl group per molecule. These materials are reported in U.S. Pat. Nos. 4,903,440 (Larson et al.) and 5,236,472 (Kirk et al.), the disclosures of which are incorporated herein by reference.

Ethylenically unsaturated monomers may be monofunctional, difunctional, trifunctional, tetrafunctional or may a higher functionality, and include both acrylate and methacrylate-based monomers. Suitable ethylenically unsaturated compounds preferably have a molecular weight of less than about 4,000 and are preferably esters made from the reaction of compounds containing aliphatic hydroxyl groups and unsaturated carboxylic acids, such as acrylic acid, methacrylic acid, itaconic acid, crotonic acid, isocrotonic acid, and maleic acid. Representative examples of ethylenically unsaturated monomers include methyl methacrylate, ethyl methacrylate, styrene, divinylbenzene, hydroxy ethyl acrylate, hydroxy ethyl methacrylate, hydroxy propyl acrylate, hydroxy propyl methacrylate, hydroxy butyl acrylate, hydroxy butyl methacrylate, lauryl acrylate, octyl acrylate, 2 (2-ethoxyethoxy) ethylacrylate, tetrahydrofurfuryl methacrylate, cyclohexyl acrylate, stearyl acrylate, 2-phenoxyethyl acrylate, isooctyl acrylate, isobornyl acrylate, isodecyl acrylate, polyethylene glycol monoacrylate, polypropylene glycol monoacrylate., vinyl toluene, ethylene glycol diacrylate, polyethylene glycol diacrylate, ethylene glycol dimethacrylate, hexanediol diacrylate, triethylene glycol diacrylate, 2 (2-ethoxyethoxy) ethyl acrylate, 2-phenoxy ethyl acrylate, propoxylated trimethylol propane triacrylate, trimethylolpropane triacrylate, glycerol triacrylate, pentaerthyitol triacrylate, pentaerythritol trimethacrylate, pentaerythritol tetraacrylate and pentaerythritol tetramethacrylate. Other ethylenically unsaturated materials include monoallyl, polyallyl, and polymethallyl esters and amides of carboxylic acids, such as diallyl phthalate, diallyl adipate, and N,N-diallyladipamide. Still other nitrogen containing compounds include tris(2-acryl-oxyethyl)isocyanurate, 1,3,5-tri(2-methyacryloxyethyl)-s-triazine, acrylamide, methylacrylamide, N-methyl-acrylamide, N,N-dimethylacrylamide, N-vinyl-pyrrolidone, and N-vinyl-piperidone.

A preferred binder precursor comprises a blend of a multifunctional acrylate with a monofunctional acrylate, for example, a trifunctional acrylate resin and a mono functional acrylate resin. Alternatively, the binder precursor may comprise a blend of a tetrafunctional acrylate resin and a monofunctional acrylate resin. An example of one binder precursor is a blend of propoxylated trimethylol propane triacrylate and 2 (2-ethoxyethoxy) ethyl acrylate. A multifunctional acrylate/monofunctional acrylate blend typically comprises about 10 to 90 parts by weight multifunctional acrylate resin and about 10 to 90 parts by weight monofunctional acrylate resin. Preferably, the binder precursor blend comprises about 30 to 70 parts by weight multifunctional acrylate resin and about 30 to about 70 parts by weight monofunctional acrylate resin. Most preferably, the binder precursor blend comprises about 40 to 60 parts by weight multifunctional acrylate resin and about 40 to 60 parts by weight monofunctional acrylate resin.

It is also within the scope of this invention to formulate a binder precursor that comprises a mixture of an acrylate resin and an epoxy resin such as reported in U.S. Pat. No. 4,751,138 (Tumey et al.), the disclosure of which is incorporated herein by reference.

Isocyanurate derivatives having at least one pendant acrylate group and isocyanate derivatives having at least one pendant acrylate group are reported in U.S. Pat. No. 4,652,274 (Boettcher et al.), the disclosure of which is incorporated herein by reference. A preferred isocyanurate is a triacrylate of tris(hydroxy ethyl) isocyanurate.

Acrylated urethanes are multifunctional acrylate esters of hydroxy terminated isocyanate extended polyesters or polyethers. Examples of commercially available acrylated urethanes include those available under the trade designation "UVITHANE 782" (commercially available from Morton Chemical), "CMD 6600", "CMD 8400" and "CMD 8805" (commercially available from UCB Radcure Specialties, Smyrna, GA.), "PHOTOMER 6010" (commercially available from Henkel Corp., Hoboken, N.J.), "EBECRYL 220" (hexafunctional aromatic urethane acrylate of molecular weight 1000), "EBECRYL 284" (aliphatic urethane diacrylate of 1200 molecular weight diluted with 1,6-hexanediol diacrylate), "EBECRYL 4827" (aromatic urethane diacrylate of 1600 molecular weight), "EBECRYL 4830" (aliphatic urethane diacrylate of 1200 molecular weight diluted with tetraethylene glycol diacrylate), "EBECRYL 6602" (trifunctional aromatic urethane acrylate of 1300 molecular weight diluted with trimethylolpropane ethoxy triacrylate), "EBECRYL 840" (aliphatic urethane diacrylate of 1000 molecular weight) and "EBECRYL 8402" (aliphatic urethane diacrylate oligomer) ("EBECRYL" resins are commercially available from UCB Radcure Specialties, Smyrna GA.), "SARTOMER 9635", "SARTOMER 9645", "SARTOMER 9655", "SARTOMER 963-B80" and "SARTOMER 966-A80" (commercially available from Sartomer Co., Exton, PA.).

Acrylated epoxies are diacrylate esters of epoxy resins, such as the diacrylate esters of bisphenol A epoxy resin. Examples of acrylated epoxies include those available under the trade designations "CMD 3500", "CMD 3600" and "CMD 3700" (commercially available from UCB Radcure Specialties, Smyrna GA.).

Acrylated polyesters are the reaction products of acrylic acid with a dibasic acid/ aliphatic diol-based polyester. Examples of commercially available acrylated polyesters include those available under the trade designations "PHOTOMER 5007" (hexafunctional acrylate of 2000 molecular weight) and "PHOTOMER 5018" (tetrafunctional acrylate of 1000 molecular weight) (commercially available from Henkel Corp.), "EBECRYL 80" (tetrafunctional modified polyester acrylate of 1000 molecular weight), "EBECRYL 450" (fatty acid modified polyester hexaacrylate) and "EBECRYL 830" (hexafunctional polyester acrylate of 1500 molecular weight) (commercially available from UCB Radcure Specialties, Smyrna GA.).

A preferred binder precursor comprises a blend of an acrylated oligomer resin and an acrylate monomer resin, for example, a blend of an acrylated urethane resin and an acrylate monomer resin. The acrylate monomer resin may be tetrafunctional, trifunctional, difunctional, monofunctional or a combination thereof. For example, the binder precursor may contain a blend of an acrylated urethane resin and one or more monofunctional acrylate resins.

Examples of ethylenically unsaturated diluents or monomers may be found in U.S. Pat. Nos. 5,236,472 (Kirk et al.) and 5,580,647 (Larson et al.), the disclosures of which are incorporated herein by reference. In some instances these ethylenically unsaturated diluents are useful because they tend to be compatible with water. Additional reactive diluents are disclosed in U.S. Pat. No. 5,178,646 (Barber et al.), the disclosure of which is incorporated herein by reference.

The binder precursor may also be an acrylate dispersion such as described in U.S. Pat. No. 5,378,252 (Follensbee), the disclosure of which is incorporated herein by reference.

Thermoplastic binders may also be suitable. Examples of thermoplastic binders include polyamides (i.e., nylon), polyethylene, polypropylene, polyesters, polyurethanes, polyetherimide, polysulfone, polystyrene, acrylonitrile-butadiene-styrene block copolymer, acetal polymers, polyvinyl chloride and combinations thereof.

It is also feasible to use a water-soluble binder precursor which may be further blended with a thermosetting resin. Examples of water-soluble binder precursors include polyvinyl alcohol, hide glue, and water-soluble cellulose ethers (e.g., hydroxypropylmethyl cellulose, methyl cellulose and hydroxyethylmethyl cellulose). Additional details on this type of chemistry may be found in U.S. Pat. No. 4,255,164 (Butkze et al.), the disclosure of which is incorporated herein by reference. Reactive Siloxane Polymer:

The abrasive coating may optionally include a siloxane polymer which is capable of reacting with the binder precursor. Suitable reactive siloxane polymers are reported in copending application having Serial No. 09/218,386, U.S. Pat. No. 6238449 (Attorney's Docket No.: 53717USA2A (Woo et al.), "ABRASIVE ARTICLE HAVING AN ABRASIVE COATING COMPRISING A SILOXANE POLYMER"), filed the same day as the instant application, the disclosure of which is incorporated herein by reference.

As used herein "reactive polysiloxane polymer" or "polysiloxane polymer" refers to any of the polymers represented by formula (I), formula (II) or a mixture thereof.

Formula (I) is:

(I)

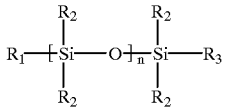

where n is 50 to 1000.

In formula (I), $R_1$ is:

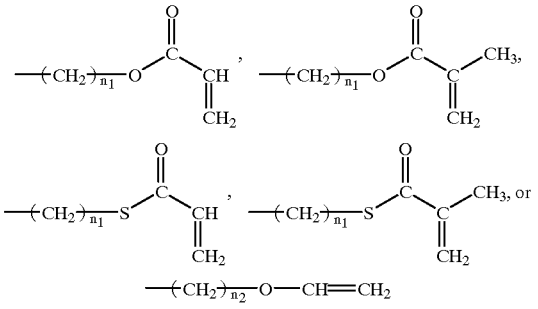

where $n_1$ is an integer from 3 to 12 and where $n_2$ is an integer from 3 to 10.

$R_2$ is independently methyl, ethyl, or phenyl.

$R_3$ is:

an aliphatic group having from 1 to 10 carbon atoms, an aromatic group, preferably having from 6 to 12 carbon atoms,

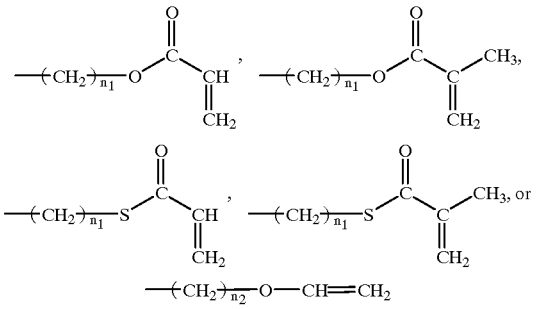

where $n_1$ is an integer from 3 to 12 and where $n_2$ is an integer from 3 to 10.

Formula (II) is:

(II)

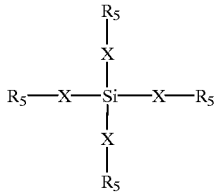

In formula (II), X is:

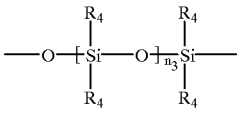

where $n_3$ is an integer from 5 to 500 and where the terminal oxygen atom of X is connected to the Si atom of formula (II).

$R_4$ is independently methyl, ethyl, or phenyl.

$R_5$ is independently:

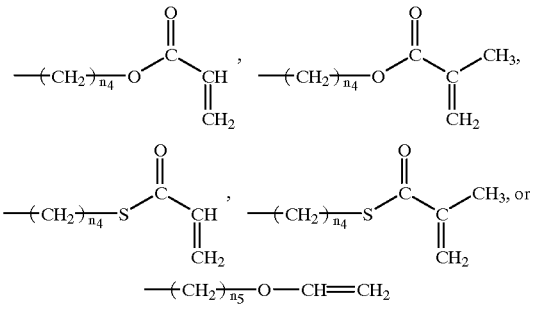

where $n_4$ is an integer from 3 to 12 and where $n_5$ is an integer from 3 to 10.

The reactive polysiloxane polymers represented by formulas (I) and (II) have at least one functional group that is capable of reacting with a binder precursor. Functional groups include alpha, beta-unsaturated carbonyl groups (i.e., acrylates, methacrylates, thioacrylates, thiomethacrylates) or vinyl ether groups. When incorporating reactive polysiloxane polymers, suitable binder precursors have functional groups which are capable of reacting with the reactive siloxane polymer. The preferred binder precursors are free radically curable materials such as acrylates or methacrylates. A particularly preferred siloxane polymer is poly (dimethylsiloxane) monomethacrylate having a number average molecular weight ranging from about 9,000 to 12,000 grams/mole (commercially available as catalog number 39,630-3 from Sigma-Aldrich Corp., St. Louis, Mo.).

When manufacturing abrasive articles of the present invention, the adhesion between the abrasive coating and the production tool may be greater than the internal strength of the nonwoven backing and/or the bond between the abrasive coating and the nonwoven backing. In these instances, when the abrasive coating is removed from the production tool, the backing may split and/or the abrasive coating may separate from the backing. By including a reactive siloxane polymer in the abrasive coating, the adhesion between the abrasive coating and the production tool is reduced thereby allowing the abrasive coating to be more easily removed from the production tool. Release from the production tool is important not only to prevent damage to the abrasive article. If the abrasive coating sticks to the production tool this may reduce the number of times that the production tool can be reused since it becomes clogged with residual abrasive coating.

Utilization of reactive siloxane polymers is a particularly advantageous way of providing release from a production tool in that these materials, which are chemically bonded to the binder, do not typically transfer to the surface of the workpiece during abrading. The transfer of any release promoting material to the surface of a workpiece by an abrasive article is generally disfavored since this may interfere with the adhesion and/or wetting of coatings which are subsequently applied over the abraded surface.

Filler:

The abrasive coating may optionally include a filler. A filler may be advantageous to alter the erodibility of the abrasive coating, reduce the cost of the abrasive article, alter the rheology of the abrasive slurry and/or to alter the abrading characteristics of the abrasive article. Examples of fillers include talc, glass particles, glass spheres, glass bubbles, bubble structures of other inorganic or organic materials, silica fume, talc, wood flour, wood particles, organic or inorganic fibers, very fine abrasive particles, thermoplastic particles, thermosetting particles, and the like. Other fillers include inorganic salts, sulfur, organic sulfur compounds, graphite, boron nitride, and metallic sulfides. The fillers may also be provided with a surface treatment such as described above for abrasive particles.

Plasticizer:

The abrasive coating may optionally include a plasticizer. In general, the addition of the plasticizer will soften the binder and may increase the erodibility of the abrasive coating. The plasticizer is preferably compatible with the binder to minimize phase separation. Examples of plasticizers include polyethylene glycol, polyvinyl chloride, dibutyl phthalate, alkyl benzyl phthalate, polyvinyl acetate, polyvinyl alcohol, cellulose esters, phthalate, silicone oils (e.g., as reported in U.S. Pat. No. 5,453,312 (Haas et al.)), adipate and sebacate esters, polyols, polyols derivatives, t-butylphenyl diphenyl phosphate, tricresyl phosphate, castor oil, combinations thereof and the like. The preferred plasticizers are phthalate derivatives.

Initiator:

In the case of binder precursors containing ethylenically unsaturated monomers and oligomers, polymerization initiators may be used. Examples of initiators include organic peroxides, azo compounds, quinones, nitroso compounds, acyl halides, hydrazones, mercapto compounds, pyrylium compounds, imidazoles, chlorotriazines, benzoin, benzoin alkyl ethers, diketones, phenones, and mixtures thereof. Suitable ultraviolet light activated photoinitiators include those sold under the trade designations "IRGACURE 651" and "IRGACURE 184" (commercially available from Ciba Geigy Company, Tarrytown, N.Y.) and "DAROCUR 1173" (commercially available from Merck & Co., Merck Chemicals Division, Rahway, N.Y.). Examples of suitable visible light activated initiators may be found in U.S. Pat. No. 4,735,632 (Larson et al.) and the initiator sold under the trade designation "IRGACURE 369" (available from Ciba Geigy Company).

Typically, an initiator is used in an amount ranging from about 0.1% to 10% by weight, preferably 2% to 4% by weight, based on the weight of the binder precursor. It is preferred to uniformly disperse the initiator in the binder precursor prior to the addition of any particulate material, such as abrasive particles or filler particles.

In the case of light activated polymerizations, the abrasive slurry may optionally include a photosensitizer. Examples of photosensitizers include compounds having carbonyl groups or tertiary amino groups and mixtures thereof. Among the preferred compounds having carbonyl groups are benzophenone, acetophenone, benzil, benzaldehyde, o-chlorobenzaldehyde, xanthone, thioxanthone, 9,10-anthraquinone, and other aromatic ketones which can act as photosensitizers. Among the preferred tertiary amines arc methyldiethanolamine, ethyldiethanolamine, triethanolamine, phenylmethyl-ethanolamine, and dimethylaminoethylbenzoate. Commercially available photosensitizers include those sold under the trade designations "QUANTICURE ITX", "QUANTICURE QTX", "QUANTICURE PTX", "QUANTICURE EPD" (from Biddle Sawyer Corp., New York, N.Y.). The amount of photosensitizer typically varies from about 0.01% to 10% by weight, more preferably from about 0.25% to 4.0% by weight, based on the weight of the binder precursor.

In general, it is preferred that the binder precursor be exposed to radiation energy, preferably ultraviolet light and/or visible light, to form the binder. In some instances, certain abrasive particles and/or certain additives will absorb ultraviolet and visible light, which makes it difficult to properly cure the binder precursor. This phenomenon occurs, for example, with cerium oxide abrasive particles and silicon carbide abrasive particles. It has been found that the use of phosphate containing photoinitiators, in particular acylpbosphine oxide containing photoinitiators, tend to overcome this problem. One example of such a photoinitiator is 2,4,6-trimethylbenzoyldiphenylphosphine oxide , sold under the trade designation "LR8893" (commercially available from BASF Corp., Mt. Olive, N.J.). Other examples of commercially available acylphosphine oxide containing photoinitiators include those sold under the trade designations "DAROCUR 4263" and "DAROCUR 4265" (commercially available from Merck & Co., Merck Chemicals Division, Rahway, N.J.).

For some binder precursors, such as epoxy or vinyl ethers, cationic initiators may be used to initiate polymerization. Examples include salts of onium cations (e.g., arylsulfonium salts) as well as organometallic salts such as ion arene systems. Examples of cationic initiators are reported in U.S. Pat. Nos. 4,751,138 (Tumey et al.), 5,256,170 (Harmer et al.), 4,985,340 (Palazotto), and 4,950,696 (Brown-Wensley et al.), the disclosures of which are incorporated herein by reference.

Dual-cure and hybrid-cure systems may also be used. In dual-cure systems, curing occurs in two separate stages, via either the same or a different reaction mechanism. In hybrid-cure systems, two different curing mechanisms occur at the same time upon exposure to ultraviolet/visible or electron beam.

Other Additives:

The abrasive coating may further comprise optional additives such as abrasive particle surface modification additives, coupling agents, expanding agents, fibers, antistatic agents, suspending agents, lubricants, wetting agents, surfactants, pigments, dyes, UV stabilizers, complexing agents, chain transfer agents, accelerators, catalysts, and activators. The amounts of these materials are selected to provide the properties desired.

Water or organic solvent may also be incorporated into the abrasive slurry. The amount of water or organic solvent is selected to achieve the desired coating viscosity. In general, the water or organic solvent should be compatible with the binder precursor. The water or solvent may be removed following polymerization of the precursor, or it may remain with the binder. Water soluble and/or water sensitive additives such as polyvinyl alcohol, polyvinyl acetate, cellulosic based particles and the like may also be included to increase the erodibility of the abrasive surface.

Structured Abrasive Coating:

As shown in FIG. 2, the working surface of the abrasive coating may have a structured topography comprising a plurality of precisely-shaped shaped abrasive composites. The abrasive composites are preferably arranged on the backing in a predetermined pattern. Typically and preferably, the abrasive composites are formed or molded into a precise shape by a production tool which ha a plurality of precisely-shaped cavities. Therefore, the predetermined pattern of the composites will correspond to the pattern of the cavities in the production tool. The pattern is thus reproducible from article to article.

The predetermined pattern may be a regular or random array. Regular arrays include, for example, aligned rows and columns of abrasive composites and offset rows of abrasive composites. That is, one row of abrasive composites may be directly aligned in front of a second row of abrasive composites. Alternatively, one row of abrasive composites may be offset from the second row of abrasive composites. It is preferred that adjacent rows of abrasive composites are offset from one another.

Alternatively, the predetermined pattern may comprise a random array. By random it is meant that the composites are not in a regular array of rows and columns as described above. For example, the abrasive composites may be arranged in a manner as described in WO PCT 95/07797 (Hoopman et al.) and WO PCT 95/22436 (Hoopman et al.). It is understood, however, that this random array is a predetermined pattern in that the location of the composites on the abrasive article is predetermined and corresponds to the location of the cavities in the production tool which is used to make the abrasive article.

The shape of the abrasive composites is typically a geometric shape such as a cube, cylinder, prism, pyramid, truncated pyramid, cone, truncated cone, hemisphere, cross, or post-like with a flat top surface. Pyramidal composites may have four sides, five sides or six sides. A mixture of more than one shape of abrasive composite is also within the scope of the invention.

The sides forming the abrasive composites may be perpendicular relative to the backing, or they may be tapered with diminishing width toward the distal end (i.e., the end spaced away from the nonwoven web) of the composite. Abrasive composites having tapered sides are preferred since they release easier from the production tool. The angle forming the taper typically ranges from about 1° to 75°, preferably ranging from about 2° to 50°, more preferably ranging from about 3° to 35°, and most preferably ranging from about 5° to 15°. Lower angles are preferred because this results in a more uniform cross sectional area along the height of the abrasive composite. A uniform cross sectional area is preferred because this provides a more consistent working surface during abrading. Thus, the taper angle is a compromise between an angle large enough to promote easy release from the production tool and an angle small enough to provide a relatively uniform cross sectional area.

The height of the abrasive composites is typically less than about 800 micrometers, more particularly ranging from about 25 to about 200 micrometers. Preferably, the height of each abrasive composite on an abrasive article is the same. It is possible, however, to have composites of varying heights within the same abrasive article.

The diameter or cross sectional width of the abrasive composites typically ranges from about 5 to about 500 micrometers, preferably ranging from about 10 to about 250 micrometers, and most preferably ranging from about 15 to about 150 micrometers.

The spacing of the abrasive composites may vary from about 1 to 100 abrasive composites per linear centimeter, preferably ranging from about 5 to 80 abrasive composites per linear centimeter, more preferably ranging from about 10 to 60 abrasive composites per linear centimeter, and most preferably ranging from about 15 to 50 abrasive composites per linear centimeter. In addition, the spacing may be varied such that the concentration of abrasive composites is greater in one location than in another. For example, the concentration of abrasive composites may be greatest in the center of an abrasive article.

The areal density of abrasive composites typically ranges from about 1 to 12,000 composites/cm$^2$, preferably ranging from about 50 to 7,500 abrasive composites/cm$^2$ and most preferably ranging from about 50 to 5,000 abrasive composites/cm$^2$.

The abrasive composites may have substantially the same orientation or the orientation of individual abrasive composites may be different from one another. One potential advantage of having different orientations is to increase the packing density of abrasive composites. For example, in one embodiment, adjacent abrasive composites are rotated about 45 degrees from one another. In another embodiment, adjacent abrasive composites are mirror images of one other. As used herein, two composites are "adjacent composites" if no intervening composite is located on a direct imaginary line drawn between the centers of the composites.

The base of the abrasive composites can abut one another or the bases of adjacent abrasive composites may be separated from one another by a distance. In some embodiments, the physical contact between adjacent abrasive composites involves no more than 33% of the vertical height dimension of each contacting composite. More preferably, the amount of physical contact between the abutting composites is in the range of about 1 to about 25% of the vertical height of each contacting composite. It is to be understood that this definition of abutting also covers an arrangement where adjacent composites share a common land or bridge-like structure which contacts and extends between facing sidewalls of the composites. Preferably, the land structure has a height of no greater than about 33% of the vertical height dimension of each adjacent composite. The land is formed from the same slurry used to form the abrasive composites. It is preferred that at least portions of the abrasive composites be separated from one another so as to provide the recessed areas between the raised portions of the composites as described above.

The abrasive article also may have a variable abrasive coating composition. For example, the center of an abrasive disc may contain an abrasive coating that is different (i.e., softer, harder, or more or less erodible) from the outer region of the abrasive disc.

Figure 3:
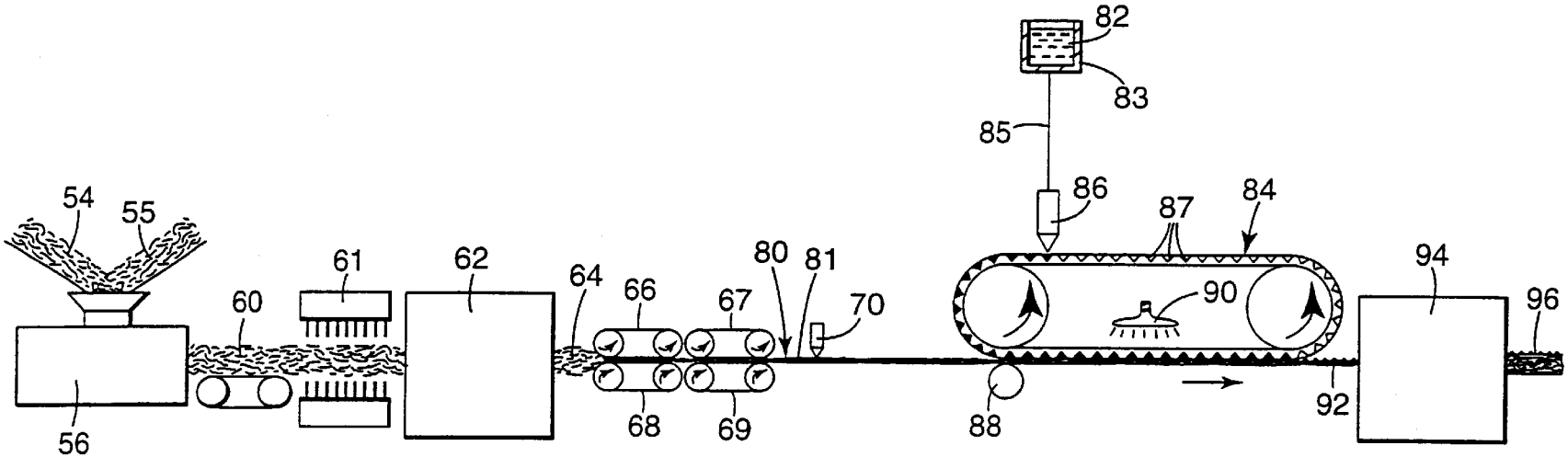
FIG. 3 is a schematic illustration of a process and apparatus useful in making an abrasive article of the present invention.

Methods of Making Abrasive Articles:

FIG. 3 illustrates a typical process and apparatus for making a preferred embodiment of an abrasive article of the present invention. First, a multiplicity of a first staple fiber 54 and a second (bicomponent) fiber 55 are combined together at web forming station 56 using the method described in U.S. Pat. No. 2,958,593 (Hoover et al.) or the method described in U.S. Pat. No. 3,537,121 (McAvoy) to form nonwoven web precursor 60. Web precursor 60 is optionally needle-tacked at needle-tacking station 61. Following this, web precursor 60 is preferably melt-bonded by passing through melt-bonding station 62 to form melt-bonded web 64. Melt-bonding station 62 is typically a heated air space, for example, an oven. While melt-bonded web 64 is at a temperature sufficient to melt the lower heat stable component of the second fibers, it is passed through opposing belts 66 and 68. Belts 66 and 68 compress and densify melt-bonded web 64. While being held in compression, melt-bonded web 64 is passed through opposing belts 67 and 69 which are driven by a series of rollers. While being held in compression between belts 67 and 69 the melt-bonded web 64 is cooled to room temperature or lower in order to "set" the web in its densified state. Cooling may be provided, for example, by a fan or water cooled plate(s) located behind belt(s) 67 and/or 69. The ratio of the density of densified web 80 to melt-bonded web 64 may vary considerably, however, it is preferred that the densification ratio (expressed as the thickness of the web prior to densification relative to the thickness of the web after densification) ranges from about 2:1 to 15:1, more preferably ranging from about 4:1 to 7:1.

Densified web 80 may be uniformly or non-uniformly densified. A non-uniformly densified web may be produced, for example, by heating one surface of the web to a higher temperature than the bulk of the web during the compression step. This may be accomplished, for example, by contacting a major surface of the web with a heated surface such as a heated plate during densification. Since densification typically increases the stiffness of a nonwoven web, non-uniform densification may be preferred in order to provide a web having a densified major surface while retaining high flexibility. Flexibility of the densified web may be desirable to allow the web to readily conform to the production tool during application of the abrasive slurry. After the coating step, the web may optionally be processed through hot and cold compressing zones to improve its strength and dimensional stability before rebulking into the final desirable form.

Densified nonwoven web 80 has major surface 81 which is relatively continuous and smooth. A relatively continuous and smooth major surface is preferred because recessed areas or voids in the densified major surface of the web (created by the random fiber alignment) may result in malformed abrasive composites. That is, the composites formed over areas of the nonwoven web having recesses or voids may not be precisely-shaped. Malformations are particularly likely to be observed when the desired abrasive coating has small (i.e., having a height less than about 0.17 mm) precisely- shaped abrasive composites.

Optionally, the major surface 81 of densified nonwoven web 80 may be made more continuous and/or smooth by flame treating major surface 81, applying a tie coating over major surface 81, or a combination thereof. In some embodiments, flame treatment and/or tie coating may also provide increased adhesion between the abrasive coating and the nonwoven web. Treating the major surface 81 of the nonwoven web with a high intensity flame treatment melts at least some of the surface fibers which flow to provide a more continuous and/or smooth densified major surface. Alternatively, a thin, flexible tie coating may be applied over major surface 81 to fill the recessed areas and/or voids on the surface of the nonwoven web. As used herein the term "tie coating" refers to a coating which is applied between the abrasive coating and the nonwoven web in an abrasive article of the present invention. A preferred tie coating comprises a blend of 70% polyamide hot melt (commercially available under the trade designation "VESTAMELT 732" from Huls America) and 30% acrylate-functional epoxy oligomer (commercially available under the trade designation "EBECRYL 3720" from UCB Chemicals) cured with 1% free-radical photoinitiator (commercially available under the trade designation "IRGACURE 651" from Ciba Specialty Chemicals). Such a tie coating is reported in copending application having Ser. No.: 09/219,289 (Attorney's Docket No. 54530USA7A (Follensbee et al.), "ACRYLATED OLIGOMER/THERMOPLASTIC POLYAMIDE PRESIZE COATINGS FOR ABRASIVE ARTICLE BACKINGS"), filed the same day as the instant application, the disclosure of which is incorporated herein by reference. In FIG. 3, device 70 represents a flame treatment device and/or a coating station for applying such a tie coating.

It is to be understood that the preferred density for applying a sheet-like abrasive coating to the densified nonwoven web 80 may depend upon factors such as the type and size of the fibers in the nonwoven web, the viscosity of the abrasive slurry, the use of a flame treatment or tie coating, whether the web is uniformly or non-uniformly densified, and process features such as the speed of the web, speed of cure of the abrasive slurry, the coating technique, and the like.

After formation of the densified web 80, an abrasive slurry is applied. The abrasive slurry may be applied in a process which is continuous with the manufacturing process of the nonwoven web (see, for example, FIG. 3) or the abrasive slurry may be applied in a separate process.

The abrasive slurry is then solidified to form an abrasive coating. The abrasive coating has a working surface which may have a textured (see, FIG. 1) or structured (see, FIG. 2) topography. A preferred method for applying an abrasive coating having a structured topography is reported in U.S. Pat. Nos. 5,152,917 (Pieper et al) and 5,435,816 (Spurgeon et al.). Other suitable methods may be found in U.S. Pat. Nos. 5,437,754 (Calhoun), 5,454,844 (Hibbard et al.), 5,437,7543 (Calhoun); 5,435,816 (Spurgeon et al.), and 5,304,223 (Pieper et al.), the disclosures of which are incorporated herein by reference.

A preferred method for applying a structured abrasive coating comprises the steps of:

(a) providing a production tool having a major surface with a plurality of precisely-shaped cavities;

(b) at least partially filling the cavities of the production tool with an abrasive slurry;

(c) introducing a densified nonwoven web to the surface of the production tool such that the slurry wets a major surface of the web;

(d) at least partially solidifying the binder precursor while the nonwoven web is in contact with the abrasive slurry and while the abrasive slurry is held within the cavities of the production tool; and (e) separating the nonwoven web from the production tool.

Referring to FIG. 3, abrasive slurry 82 (held in reservoir 83) is fed through feed line 85 to coating station 86. At coating station 86 the precisely-shaped cavities 87 of production tool 84 are at least partially filled (preferably completely filled) with abrasive slurry 82.

Production Tool:

Production tool 84 contains a plurality of precisely-shaped cavities 87 distending as indentation from the major surface. The cavities are essentially the inverse shape of the abrasive composites and are responsible for generating the shape and placement of the abrasive composites on the abrasive article.

These cavities may have any geometric shape that is the inverse shape to the geometric shapes suitable for the abrasive composites. The dimensions of the cavities are selected to achieve the desired number areal density of abrasive composites.

The production tool may be in the form of a belt, a sheet, a continuous sheet or web, a coating roll (i.e., a rotogravure roll), a sleeve mounted on a coating roll, or die. In FIG. 3, the production tool is in the form of a belt. The production tool may be composed of metal, (e.g., nickel), metal alloys or polymers. The production tool may be fabricated by any conventional technique, including photolithography, knurling, engraving, hobbing, electroforming or diamond turning. For example, a copper tool may be diamond turned and then a nickel metal tool may be electroplated off of the copper tool. In some instances, a photolithography process is desired because it creates patterns that cannot or are otherwise difficult and expensive to generate by other techniques such as diamond turning.

A production tool made of a thermoplastic polymer may be replicated off a master tool. The master tool will have the inverse pattern desired for the production tool. The master tool is preferably made out of metal (e.g., nickel-plated aluminum, copper or bronze). A thermoplastic polymer sheet material may be heated along with the master tool such that the thermoplastic sheet material is embossed with the master tool pattern by pressing the two together. Alternatively, the thermoplastic polymer may be extruded or cast onto to the master tool. The thermoplastic material is then cooled to a non-flowable state and separated from the master tool to produce a thermoplastic production tool. Examples of thermoplastic polymer materials that may be useful to form the production tool include polyesters, polypropylene, polyethylene, polyamides, polyurethanes, polycarbonates, combinations thereof and the like. Additionally in some instances, it is preferred that the thermoplastic production tool contain additives such as anti-oxidants and/or UV stabilizers. These additives may extend the useful life of the production tool. The production tool may also contain a release coating to permit easier release of the abrasive article from the production tool. Examples of such release coatings include silicones and fluorochemicals.

Additional details on how to make a production tool may be found in U.S. Pat. Nos. 5,152,917 (Pieper et al.), 5,489,235 (Gagliardi et al.), 5,454,844 (Hibbard et al.), 5,435,816 (Spurgeon et al.), PCT WO 95/07797 (Hoopman et al.), and PCT WO 95/22436 (Hoopman et al.), the disclosures of which are incorporated herein by reference Coating Station:

Coating station 86 may be any conventional coating means such as drop die coater, knife coater, curtain coater, vacuum die coater or a die coater. The preferred coating technique is a vacuum fluid bearing die, such as reported in U.S. Pat. Nos. 3,594,865 (Erb), 4,959,265 (Wood), and 5,077,870 (Millage), the disclosures of which are incorporated herein by reference. During coating, the formation of air bubbles is preferably minimized. In some instances, however, it may be preferred to incorporate air into the slurry. Entrapped air may lead to porosity in the abrasive coating and may increase the erodibility of the abrasive coating.

After filling the cavities of the production tool with abrasive slurry at coating station 86, the densified web 80 and the abrasive slurry-coated production tool are brought into contact by nip roll 88 such that the abrasive slurry wets the front surface of the densified nonwoven web. Nip roll 88 is preferably made from a metal, metal alloy, rubber or ceramic. The hardness of the nip roll may range from about 30 to about 120 durometer, typically ranging from about 60 to about 100 durometer, and preferably about 90 durometer.

Next, the binder precursor in the abrasive slurry is at least partially solidified (preferably fully solidified) by exposure to an energy source 90.

Energy Source:

Energy source 90 may be a source of thermal energy or radiation energy (e.g., electron beam, ultraviolet light or visible light). The amount of energy required is typically dependent upon the chemical nature of the reactive groups in the binder precursor, as well as upon the thickness and density of the binder precursor coating.

For thermal energy, an oven temperature ranging from about 50° C. to about 250° C. and a duration ranging from about 15 minutes to about 16 hours is generally sufficient. An electron beam may be used at an energy level ranging from about 0.1 to about 10 Mrad, preferably ranging from about 1 to about 10 Mrad. Ultraviolet radiation refers to radiation comprising wavelengths ranging from about 200 to about 400 nanometers, preferably ranging from about 250 to about 400 nanometers. It is preferred that 118 to 236 Watt/cm ultraviolet lamps are used as a source of ultraviolet light. Visible radiation refers to radiation comprising wavelengths ranging from about 400 to about 800 nanometers, preferably ranging from about 400 to about 550 nanometers.

Preferably, the energy source is radiation energy. If the production tool is made from a material transparent to visible or ultraviolet radiation (e.g., polypropylene, polyethylene, polyester, polycarbonate, poly(ether sulfone), poly(methyl methacrylate), polyurethanes, polyvinylchloride, or combinations thereof) then visible or ultraviolet radiation may be transmitted through the production tool to cure the binder precursor. The energy source should be chosen so as not to appreciably degrade the production tool or backing.

Once partially solidified, the abrasive coated densified nonwoven web 92 is separated from production tool 84. Preferably, the production tool and abrasive article are separated at an angle to improve separation. The resulting abrasive coating comprises abrasive composites having the inverse pattern of the production tool. By at least partially curing or solidifying the binder precursor while in the production tool, the abrasive composites have a precise shape and predetermined pattern. If the binder precursor is not fully cured when removed from the production tool, the binder precursor may be further cured by additional exposure to a suitable energy source.

Textured Abrasive Coating:

In another embodiment of the present invention, the working surface of the abrasive coating may have a textured topography (see, FIG. 1). As used herein "textured" refers to a topography comprising a plurality of non-straight, non-distinct, inexact or imperfectly shaped protuberances.

In one method of forming an abrasive coating having a textured topography, the abrasive slurry is first coated into precisely-shaped cavities of a production tool. In this method, however, the abrasive slurry is removed from the production tool before the binder precursor is solidified sufficiently for it to retain its shape. Hence, the abrasive slurry flows and distorts upon removal from the production tool. It is generally preferred that the time between removal of the slurry-coated backing from the production tool to solidification of the binder precursor is relatively short. If this time is too long, the slurry will flow and the texture may disappear. Subsequent to removal from the production tool, the binder precursor is solidified. Optionally, the slurry may be partially solidified while in contact with the production tool, provided that the slurry is removed before the binder precursor is solidified sufficiently to retain its shape. Subsequent to this, the binder precursor is cured or solidified by exposure to an energy source as described above. Additional details on how to make this type of abrasive article may be found, for example, in U.S. Pat. Nos. 4,773,920 (Chasman et al.) and 5,014,468 (Ravipati et al.), the disclosures of which are hereby incorporated by reference.

In another method of making a textured topography, the abrasive slurry is first coated onto the surface of a rotogravure roll. The densified nonwoven web then contacts the slurry-coated gravure roll causing at least part of the abrasive slurry to transfer to the densified nonwoven web. The rotogravure roll imparts a texture to the surface of the transferred abrasive slurry.

Another method of making a textured topography comprises spraying or coating an abrasive slurry through a screen. The binder precursor is then solidified to form the abrasive coating having a textured working surface. This type of process is further described in U.S. Pat. No. 3,605,349 (Anthon), the disclosure of which is incorporated herein by reference.

Yet another technique for making a textured topography comprises imparting texture to the surface of the densified rebulkable nonwoven web. This may be accomplished, for example, by embossing the surface of the nonwoven web. Once embossed, the abrasive slurry is coated onto the embossed surface thereby providing a textured topography. The slurry may be applied over the textured backing by any suitable technique such as roll coating, spraying, die coating or knife coating. An example of an abrasive coating applied over an embossed backing may be found in U.S. Pat. No. 5,015,266 (Yamamoto et al.), the disclosure of which is incorporated herein by reference.

Rebulking:

After application of the abrasive coating, the abrasive coated densified web 92 is passed through a rebulking station 94 to effectuate rebulking of the densified web. Typically, rebulking station 94 is an oven. In a preferred embodiment where the nonwoven web includes bicomponent fibers, the web is heated to melt the lower melting component of the bicomponent fibers. The rebulking temperature depends, for example, on the composition of the fibers used to form the nonwoven web and the type of binder precursor. The temperature must be high enough to melt the lower heat stable component, but not high enough to decompose that component. The degree of rebulking may be controlled by factors such as the temperature of the rebulking station, the residence time in the rebulking station, the composition of the fibers in the web including the degree and type of crimp in the fibers.

After rebulking, the abrasive coated rebulked web 96 may be converted into the desired form (i.e., size, shape, etc.) for use as an abrasive article. Alternatively, the abrasive coated densified web 92 may be first converted into the desired form followed by rebulking. In this case, a batch type rebulking process is preferred. Abrasive articles of the invention may take any of a variety of shapes and sizes. For example, the article may be circular, elliptical, or quadrangular. A preferred article is circular and is of the proper size for use on a rotary abrading device. Typically, the circular pad is from about 2 to 16 cm in diameter, and from about 0.5 to about 30 cm in thickness.

The most preferred embodiment of the present invention comprises a discshaped article having provision for mounting on electrically driven or pneumatically driven rotary hand tools. Such mounting provision includes, for example, pressure-sensitive adhesives or mechanically-interlocking fasteners that can secure the abrasive article to a back-up pad having a mandrel for mounting onto the hand tool.

EXAMPLES

The invention is further illustrated by the following example wherein all parts and percentages are by weight unless otherwise specified.

The following materials were used in the preparation of the Examples.

TATHEIC triacrylate of tris(2-hydroxy ethyl) isocyanurate, commercially available from Sartomer Co., under the trade designation "SR368".

TMPTA trimethylol propane triacrylate, commercially available from Sartomer Co., under the trade designation "SR351".

THF-A tetrahydrofuran acrylate, commercially available from Sartomer Co. under the trade designation "SR285".

D111 ionic dispersing agent, commercially available from Byk Chemie, Wallingford, Conn. under the trade designation "DISPERBYK 111".

IRG907 2-methyl-1-(4-(methylthio)phenyl)-2-(4-morpholinyl)-1-propanone, commercially available from Ciba Geigy Corp. under the trade designation "IRGACURE 907".

ITX 2-isopropylthioxanthone, commercially available from Biddle-Sawyer Corp., New York, N.Y. (distributor for Octel Chemicals, UK) under the trade designation "QUANTICURE ITX".

OX50 amorphous silica filler, commercially available from DeGussa Corp. under the trade designation "OX-50".

RSP Poly(dimethylsiloxane)monomethacrylate having a number average molecular weight ranging from about 9,000 to 12,000 grams/mole commercially available as catalog number 39,630-3 from Sigma-Aldrich Corporation, St. Louis, Mo.

GC1000 ANSI grade 1000 green silicon carbide abrasive particles, commercially available from Fujimi Abrasives, Japan.

FIB1 15-denier polyester staple fiber with 1.5" staple length, commercially available under the trade designation "Type 295" from Hoechest Celanese Inc., Charlotte, N.C.

FIB2 15-denier bicomponent binder fiber made in accordance with Example 1 of U.S. Pat. No. 5,082,720 (Hayes).

The following Example demonstrates the effectiveness of the abrasive articles of the present invention when employed to level and blend a typical automotive clear-coating. Specifically, this abrasive article is tailored to level and blend a relatively hard final clear-coating.

Preparation of Example 1:

65% by weight FIB-1 and 35% by weight FIB-2 were blended and processed through a carding and cross-lapping web processing line to form a nonwoven web having a weight of 450 g/m$^2$. The nonwoven web was needle tacked at 110 strokes per minutes at a traverse speed of about 7 feet per minute (about 2.1 m/min). The needle-tacked web was then introduced into the nip between two belts. The belts were moving at a speed of 5 feet/min (about 1.5 m/min) and were separated by a distance of 1/16" (1.6 mm). The belts were supported on their back sides by rigid platens to ensure a uniform distance between the belts. While being advanced through the nip created between the belts, the web was heated by a hot plate on the top and hot air from the bottom at a temperature of 300° F. (149° C.). Upon exiting from the first set of belts, the web was introduced into a second nip between two similar belts. While being advanced through the nip created between the second set of belts, the web was cooled with room temperature air from the bottom and a tap cold water cooling plate on the top. This procedure densified and set the web at thickness of 1/8" (3.2 mm).

One major surface of the resulting melt-bonded and densified web was flame treated in a separate operation using a propane torch. Approximately one-third of the length of the flame contacted the densified web during the flame treating operation. The torch moved over the entire major surface of the web at a speed of 1 ft./min. (0.30 m/min).

TABLE 1

| Component | Weight (grams) |
|---|---|
| GC1000 | 220.00 |
| TATHEIC | 27.11 |
| TMPTA | 63.27 |
| THF-A | 19.70 |
| D111 | 0.60 |
| IRG907 | 2.13 |
| ITX | 1.05 |
| OX50 | 1.40 |
| RSP | 1.40 |

An abrasive slurry, having the composition shown in Table 1, was applied at a rate of 40 feet/min. (12.2 m/min.) to a continuous loop polypropylene production tool using a knife coater having a gap of 0.003 mils (0.076 mm). The major surface of the production tool had a uniform pattern of triangular-based pyramidal cavities having a depth of 2.5 mils (0.06 mm) and a density of 57,000 cavities/in$^2$ (8,835 cavities/cm$^2$).

The densified nonwoven web was then placed in contact with the coated side of the production tool and the resulting structure was introduced into a nip between two rollers. To prevent stretching, the densified nonwoven web was supported by a carrier film prior to coating. Next, the abrasive slurry was exposed to ultraviolet light from one type D bulb (commercially available from Fusion Systems Inc., Gaithersburgh, Md.) operating at 600 watts/inch (236 watts/cm). The ultraviolet bulb was positioned such that the ultraviolet light passed through the production tool before entering the abrasive slurry. During exposure to the ultraviolet light, the web side of the structure was in contact with a transport mandrel heated to 130° F. The ultraviolet light initiated free radical polymerization of the binder precursor thereby solidifying the abrasive slurry. After solidification of the abrasive slurry, the nonwoven web having the abrasive coating bonded thereto was removed from the production tool.

The nonwoven web was then cut into 6-inch (15.24 cm) circular discs. The discs were then placed in an oven set at 150° C. for 2 minutes to rebulk the nonwoven web. After rebulking, the thickness of the discs measured approximately ⅜ inch (9.5 mm).

Comparative Example A:

Comp. Ex. A was a dry sanding disk commercially available under the trade designation "260L/1000" from Minnesota Mining and Manufacturing Company, St. Paul, Minn.

Test Panel Preparation:

15"×15" (38 cm×38 cm) steel panels were coated with an automotive base coating and clear coating (commercially available under the trade designation "PPG 2020" from PPG Industries, Pittsburgh, Pa.). The clear coating was allowed to dry at room temperature for approximately 24 hours before testing.

Clear Coat Abrading & Polishing Test Procedure:

A "3M Hookit Disc Pad #05725" backup pad (available from Minnesota Mining and Manufacturing Company, St. Paul, Minn.) was used for both Example 1 and Comp. Ex. A. For Comp. Ex. A, a "3M Hookit Interface Pad #5774" was used to secure the disc to the backup pad and to cushion the action of the abrasive article on the substrate. Example 1 was attached directly to the backup pad. During sanding, the back up pad was driven by a dual-action sander (commercially available under the trade designation "DAQ" from National Detroit, Rockford, Ill.) operating at 2,000 rev/min. Example 1 and Comp. Ex. A were tested side-by-side on a single test panel. Half of the test panel was abraded for 1 minute using Example 1. Example 1 was employed damp (i.e., following a light water spray applied over the sample panel). The second half of the test panel was abraded for 1 minute using Comp. Ex. A. Comp. Ex. A was employed dry in accordance with usual practice for this type of abrasive article. After abrading, the finish on each side of the test panel was evaluated visually and with a Perthometer (available from Feinpruf GmbH, Gottingen, Germany). The abrading results are summarized in Table 2.

Following the abrading, each panel was polished at 22,000 RPM with a 3M Perfect-It Foam Polishing Pad #05725 mounted on a 3M #5717 backup pad and driven by a Snap-On 7/9 electric sander/polisher (available from Snap-On Tools, Kenosha, Wis.). The polishing pad was treated with 3M Perfect-It Foam Polishing Pad Glaze #05996. After polishing for 1.5 minutes, the surface finish on each side of the test panel was evaluated visually. The polishing results are summarized in Table 2.

TABLE 2

| Abrasive Article | Abrading Results and Observations | Polishing Results and Observations |
|---|---|---|
| Comp. Ex. A | (1) Some large dirt particles were visible in the clear coat.<br>(2) Overall leveling of the clear coat was acceptable.<br>(3) Perthometer results on the clear coat: $R_a$ = 8.79, $R_z$ = 72.3, $R_{max}$ = 111. | (1) Numerous scratches were visible in the surface of the clear coat.<br>(2) An "orange peel" effect was visible in the clear coat.<br>(3) The clear coat had a dull appearance. |
| Example 1 | (1) Some large dirt particles were visible in the clear coat.<br>(2) Overall leveling of the clear coat was acceptable.<br>(3) Perthometer results on the clear coat: $R_a$ = 7.81, $R_z$ = 72.3, $R_{max}$ = 84.2. | (1) fewer scratches were visible than for Comp. Ex. A,<br>(2) The observed "orange peel" effect in the clear coat was slightly greater than for Comp. Ex. A.<br>(3) The clear coat had a bright appearance. |

Use of an abrasive article of the present invention (Example 1) resulted in fewer, shallower scratches in the clear coat than for Comp. Ex. A.

What is claimed is:

1. An abrasive article comprising:

an open, lofty rebulkable nonwoven web having a first and a second major surface; and a continuous abrasive coating in the form of a sheet or film bonded to the first major surface of the open, lofty rebulkable nonwoven web the abrasive coating comprising a plurality of abrasive particles dispersed in a binder.

2. An abrasive article according to claim 1 wherein the abrasive coating has a working surface having a structured topography comprising a plurality of precisely-shaped abrasive composites.

3. An abrasive article according to claim 2 wherein the precisely-shaped abrasive composites have a shape selected from the group consisting of cubes, cylinders, prisms, pyramids, truncated pyramids, cones, truncated cones, hemispheres and crosses.

4. An abrasive article according to claim 1 wherein the abrasive coating has a working surface having a textured topography.

5. An abrasive article according to claim 1 wherein the binder is formed from a binder precursor selected from the group consisting of phenolics, aminoplasts, urethanes, epoxies, acrylates, acrylated isocyanurates, urea-formaldehydes, isocyanurates, acrylated urethanes, acrylated epoxies and mixtures thereof.

6. An abrasive article according to claim 1 wherein the binder is formed from a free-radically polymerizable binder precursor.

7. An abrasive article according to claim 1 wherein the binder comprises the reaction product of:

a binder precursor; and a reactive siloxane polymer having at least one functional group which reacts with the binder precursor wherein the reactive siloxane polymer comprises at least one of formulas (I) or (II) or mixtures thereof:

wherein formula (I) is:

(I)

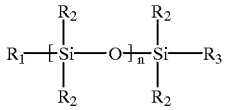

where n is 50 to 1000; and wherein $R_2$ is independently methyl, ethyl, or phenyl; and wherein $R_1$ is:

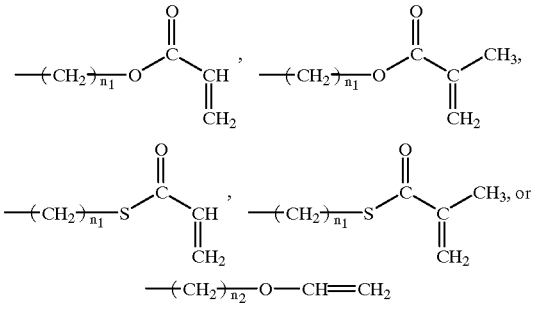

where $n_1$ is an integer from 3 to 12 and where $n_2$ is an integer from 0 to 10; and wherein $R_3$ is:

an aliphatic group having from 1 to 10 carbon atoms, an aromatic group,

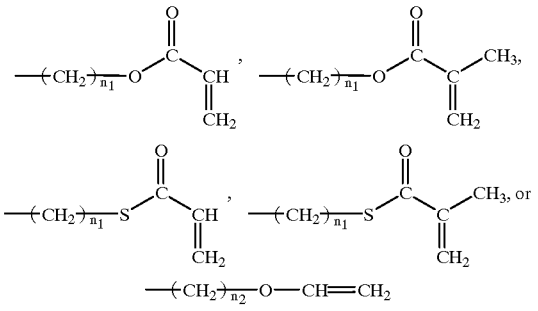

where $n_1$ is an integer from 3 to 12 and where $n_2$ is an integer from 0 to 10; and wherein formula (II) is:

(II)

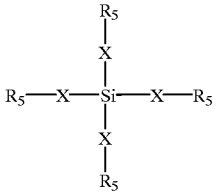

wherein X is:

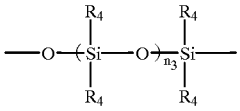

where X has a terminal oxygen atom which is connected to the silicon atom of formula (II) and where $n_3$ is an integer from 5 to 500 and where $R_4$ is independently methyl, ethyl or phenyl;

wherein $R_5$ is independently:

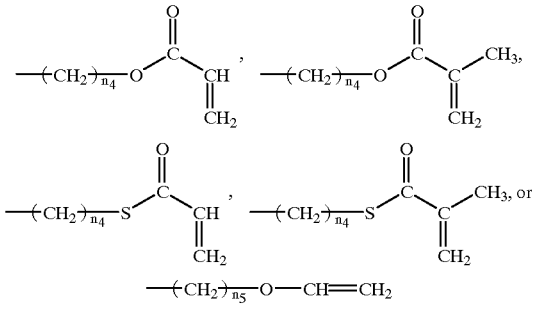

where $n_4$ is an integer from 3 to 12 and where $n_5$ is an integer from 0 to 10.

8. An abrasive article according to claim 7 wherein the reactive siloxane polymer is poly(dimethylsiloxane) monomethacrylate.

9. An abrasive article according to claim 1 wherein the abrasive particles are selected from the group consisting of boron carbide, cubic boron nitride, fused alumina, ceramic aluminum oxide, heat treated aluminum oxide, alumina zirconia, silicon carbide, iron oxides, tantalum carbide, cerium oxide, garnet, titanium carbide, synthetic diamond, natural diamond, zirconium oxide, silicon nitride and combinations thereof.

10. An abrasive article according to claim 1 wherein the rebulkable nonwoven web comprises an open, lofty web of first and second crimped, staple, organic thermoplastic fibers, the first organic thermoplastic fiber comprising a polymer selected from the group consisting of polyamides, polyolefins and polyesters, the second fiber comprising at least two polymers of different heat stability wherein the heat stability of the lower heat stable component of the second fiber is less than the heat stability of the first fiber and wherein the first and said second fibers are melt-bonded together at least at a portion of points where a first fiber contacts a second fiber.

11. An abrasive article according to claim 10 wherein said first fiber is polyester having a melting point which is greater than the melting point of the lower heat stable component of the second fiber and wherein the second fiber is a core-sheath fiber comprising a core and a sheath, said sheath comprising a material having a lower heat stability than the core and the first fiber, the core selected from the group consisting of polyamides, polyolefins and polyesters.

12. An abrasive article according to claim 10 wherein the first and second fibers have a denier ranging from about 1 to 200.

13. An abrasive article according to claim 10 wherein the first and second fibers have a denier ranging from about 3 to 15.

14. A method of making an abrasive article comprising the steps of:

(a) providing a rebulkable nonwoven web;

(b) heating the rebulkable nonwoven web;

(c) compressing the rebulkable nonwoven web to form a densified nonwoven web having at least one major surface;

(d) coating the major surface of the densified nonwoven web with an abrasive slurry comprising a plurality of abrasive particles dispersed in a binder precursor;

(e) solidifying the binder precursor of the abrasive slurry to form a continuous abrasive coating in the form of a sheet or film bonded to the major surface of the nonwoven web; and (f) heating the densified nonwoven web at a sufficient temperature and for a sufficient time to rebulk the nonwoven web to an open, lofty form.

15. A method of making an abrasive article according to claim 14 wherein the rebulkable nonwoven web comprises first and second crimped, staple, organic thermoplastic fibers, the first organic thermoplastic fiber comprising a material selected from the group consisting of polyamides, polyolefins and polyesters, the second fiber comprising at least two materials of different heat stability wherein the heat stability of the lower heat stable component of the second fibers is less than the heat stability of the first fiber and wherein the first and said second fibers are melt-bonded together at least at a portion of points where a first fiber contacts a second fiber.

16. A method of making an abrasive article according to claim 14 wherein the densified nonwoven web of step (c) has a density which is about 2 to 15 times the density of the rebulkable nonwoven web of step (a).

17. A method of making an abrasive article according to claim 14 wherein the densified nonwoven web of step (c) has a density which is about 2 to 7 times the density of the rebulkable nonwoven web of step (a).

18. A method of making an abrasive article according to claim 14 wherein the abrasive coating has a working surface having a structured topography comprising a plurality of precisely-shaped abrasive composites.

19. A method of making an abrasive article according to claim 18 wherein the precisely-shaped abrasive composites have a shape selected from the group consisting of cubes, cylinders, prisms, pyramids, truncated pyramids, cones, truncated cones, hemispheres and crosses.

20. A method of making an abrasive article according to claim 14 wherein the abrasive coating has a working surface having a textured topography.

21. A method of making an abrasive article according to claim 14 wherein the binder precursor is selected from the group consisting of phenolics, aminoplasts, urethanes, epoxies, acrylates, acrylated isocyanurates, urea-formaldehydes, isocyanurates, acrylated urethanes, acrylated epoxies and mixtures thereof.

22. A method of making an abrasive article according to claim 14 wherein the binder is formed from a free-radically polymerizable binder precursor.

23. A method of making an abrasive article according to claim 14 wherein coating step (d) comprises:

(a) providing a production tool having a major surface comprising a plurality of precisely-shaped cavities formed therein;

(b) coating the major surface of the production tool with the abrasive slurry comprising a plurality of abrasive particles dispersed in a binder precursor; and (c) laminating the major surface of the densified nonwoven web to the major surface of the production tool.

24. A method of making an abrasive article according to claim 14 wherein said abrasive slurry comprises:

a plurality of abrasive particles;

a binder precursor; and a reactive siloxane polymer having at least one functional group which reacts with the binder precursor wherein the reactive siloxane polymer comprises at least one of formulas (I) or (II) or mixtures thereof:

wherein formula (I) is:

(I)

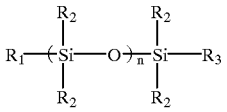

where n is 50 to 1000; and wherein $R_2$ is independently methyl, ethyl, or phenyl; and wherein $R_1$ is:

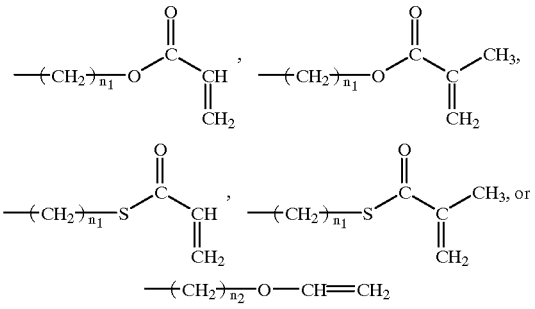

where $n_1$ is an integer from 3 to 12 and where $n_2$ is an integer from 0 to 10; and wherein $R_3$ is:

an aliphatic group having from 1 to 10 carbon atoms, an aromatic group,

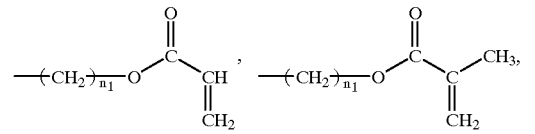

-continued

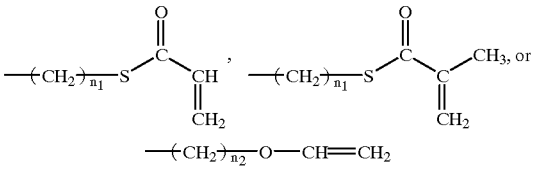

where $n_1$ is an integer from 3 to 12 and where $n_2$ is an integer from 0 to 10; and wherein formula (II) is:

(II)

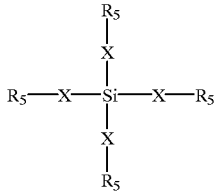

wherein X is:

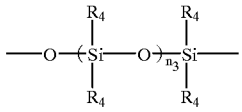

where X has a terminal oxygen atom which is connected to the silicon atom of formula (II) and where $n_3$ is an integer from 5 to 500 and where $R_4$ is independently methyl, ethyl or phenyl;

wherein $R_5$ is independently:

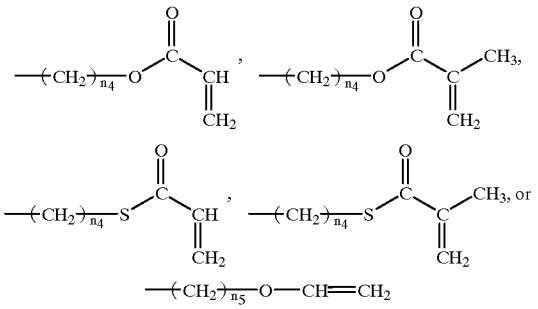

where $n_4$ is an integer from 3 to 12 and where $n_5$ is an integer from 0 to 10.

25. A method of making an abrasive article according to claim 24 wherein the reactive siloxane polymer is poly (dimethylsiloxane)monomethacrylate.

26. A method of making an abrasive article according to claim 14 wherein the solidifying step comprises exposing the abrasive slurry to ultraviolet radiation.

27. A method of making an abrasive article according to claim 14 wherein the solidifying step comprises exposing the abrasive slurry to an electron beam.

28. A method of making an abrasive article according to claim 14 further including: (a) imparting a texture to the abrasive slurry, after it has been coated on the major surface of the densified nonwoven web, by contacting the abrasive slurry with a gravure cylinder.

29. A method of making an abrasive article according to claim 14 wherein the coating step comprises:

(a) providing a gravure cylinder having a major surface including a plurality of recesses formed therein;

(b) coating the major surface of the gravure cylinder with the abrasive slurry; and (c) contacting the major surface of the densified nonwoven web with the coated major surface of the gravure cylinder such that at least a portion of the abrasive slurry transfers to the major surface of the densified nonwoven web.

30. A method of making an abrasive article according to claim 14 further including the step of:

heating the major surface of the densified nonwoven web of step (c) with a flame prior to coating the major surface of the densified nonwoven web with the abrasive slurry.

31. A method of making an abrasive article according to claim 14 further including the step of:

coating the major surface of the densified nonwoven web of step (c) with a tie coat prior to step (d), the tie coat comprising a mixture of a polyamide hot melt and an acrylate-functional epoxy oligomer.

32. A method of making an abrasive article said method comprising:

(a) providing an open, lofty nonwoven web comprising first and second crimped, staple, organic thermoplastic fibers, the first organic thermoplastic fiber comprising a material selected from the group consisting of polyamides, polyolefins and polyesters, the second fiber comprising at least two materials of different heat stability wherein the heat stability of the lower heat stable component of the second fibers is less than the heat stability of the first fiber;

(b) subjecting the nonwoven web to conditions sufficient to melt the lower heat stable component of the second fibers;

(c) compressing the nonwoven web while at the conditions of step (b);

(d) cooling the compressed nonwoven web of step (c) to form a densified nonwoven web having at least one major surface;

(e) providing a production tool having a major surface comprising a plurality of precisely-shaped cavities;

(f) filling the cavities of the production tool with an abrasive slurry, the abrasive slurry comprising a plurality of abrasive particles dispersed in a binder precursor;

(g) laminating the major surface of the densified nonwoven web to the major surface of the production tool;

(h) at least partially solidifying the binder precursor to form a continuous abrasive coating in the form of a sheet or film bonded to the major surface of the densified nonwoven web, the abrasive coating having a working surface with a structured topography;

(i) separating the abrasive article from the production tool; and (j) subjecting the abrasive article to a temperature sufficient to rebulk the densified nonwoven web.

33. An abrasive article comprising:

(a) an open, lofty rebulkable nonwoven web having a first and a second major surface, the rebulkable nonwoven web comprising:

(i) a plurality of a first crimped, staple, organic thermoplastic fiber; and (ii) a plurality of a second crimped, staple, organic thermoplastic fiber;

wherein the first fibers comprise a material selected from the group consisting of polyamides, polyolefins and polyesters and wherein the second fibers comprise at least two materials of different heat stability and wherein the first and said second fibers are melt-bonded together at least at a portion of points where a first fiber contacts a second fiber; and (b) a continuous abrasive coating in the form of a sheet or film bonded to the first major surface of the open, lofty nonwoven web, the abrasive coating comprising a plurality of abrasive particles dispersed in a binder, the abrasive coating defining a working surface having a structured topography.

* * * * *

UNITED STATES PATENT AND TRADEMARK OFFICE

CERTIFICATE OF CORRECTION

PATENT NO. : 6,312,484 B1
DATED : November 6, 2001
INVENTOR(S) : Chou, Yeun J.

It is certified that error appears in the above-identified patent and that said Letters Patent is hereby corrected as shown below:

Title page,
Item [56], References Cited, please add the following:
-- OTHER PUBLICATIONS
Fiber Blends For Thermally Bonded Monomers", Research Disclosure, November 1993, p. 741 --.

Column 4,
Line 38, please delete "Rebulkable".
Line 39, please delete "Nonwoven Web:" and insert -- Rebulkable Nonwoven Web: --.

Column 10,
Line 55, please delete "Reactive Siloxane Polymer:".
Line 56, please insert the following heading -- Reactive Siloxane Polymer: --.

Column 13,
Line 65, "tertiary amines arc" should be -- tertiary amines are --.

Column 14,
Line 65, "plurality of precisely-shaped shaped abrasive" should be -- plurality of precisely-shaped abrasive --.

Column 15,
Line 2, "a production tool which ha a plurality" should be -- a production tool which has a plurality --.

Column 18,
Lines 24-25, "5,437,7543 (Calhoun)" should be -- 5,437,754 (Calhoun) --.

UNITED STATES PATENT AND TRADEMARK OFFICE

CERTIFICATE OF CORRECTION

PATENT NO. : 6,312,484 B1
DATED : November 6, 2001
INVENTOR(S) : Chou, Yeun J.

It is certified that error appears in the above-identified patent and that said Letters Patent is hereby corrected as shown below:

Column 19,
Line 35, "incorporated herein by reference" should be -- incorporated herein by reference. --.

Signed and Sealed this

Third Day of June, 2003

JAMES E. ROGAN
*Director of the United States Patent and Trademark Office*